United States Patent [19]

Taylor

[11] 3,945,542

[45] Mar. 23, 1976

[54] CLOTH TUBE EVERTER AND METHOD OF OPERATION

[76] Inventor: Monte L. Taylor, 955 W. "G" St., Ontario, Calif. 91762

[22] Filed: Apr. 24, 1975

[21] Appl. No.: 571,315

[52] U.S. Cl. ..... 223/42
[51] Int. Cl.[2] ..... A41H 43/00
[58] Field of Search ..... 223/39, 40, 42

[56] References Cited

UNITED STATES PATENTS

| | | | |
|---|---|---|---|
| 2,116,569 | 5/1938 | Gold | 223/42 |
| 2,156,339 | 5/1939 | Horn | 223/40 |
| 2,626,090 | 1/1953 | Horsley | 223/42 |
| 3,643,840 | 2/1972 | LeBlanc | 223/42 |
| 3,746,220 | 7/1973 | Harbaugh | 223/42 |
| 3,785,893 | 1/1974 | Rotondil | 223/42 X |

*Primary Examiner*—G. V. Larkin
*Attorney, Agent, or Firm*—Edward O. Ansell

[57] ABSTRACT

A device and method for manually everting a cloth or fabric tube where all manipulations may be visually monitored. The device comprises an elongated hollow body having a convergent passageway entrance at one end thereof and a fabric attachment member connected to a handle member adapted to be selectively introduced into or removed from the other end of said hollow body. The body portion of the tool is preferably cylindrical in configuration. The means connecting the handle member and the fabric attachment member is arranged within the interior of said hollow body when the handle member is introduced into said one end thereof. With the handle member so arranged, the fabric attachment means engages the open end of the cloth tube. The tube may then be everted by moving the handle outwardly from the hollow body, thereby pulling the end of the tube into the convergent passageway entrance. This causes the fabric tube to gather and move upwardly through the hollow body. The fabric attachment means is then removed from the fabric and the open end of the gathered tube is spread over and pulled down around the outside of the hollow body while the remaining portion of the tube is automatically pulled through the cylindrical body until the entire cloth tube is reversed.

17 Claims, 7 Drawing Figures

CLOTH TUBE EVERTER AND METHOD OF OPERATION

BACKGROUND OF THE INVENTION

1. Field of the Invention

This invention relates to the field of cloth or fabric handling tools and is more particularly concerned with tools for everting tubes of cloth or fabric material.

2. Description of the Prior Art

It is often required in applications utilizing fabric or cloth, such as the clothing industry or other industries which manufacture covering materials, to assemble various pieces of material in final form with the inside turned outwardly. Long, thin pieces of cloth that have been sewn wrong side out are commonly called tubes. After these tubes are reversed, they are used as belts or ties, as parts of wearing apparel, and particularly dresses, shirts or blouses. By everting them, all seams between adjacent pieces are hidden from view when the finished item is everted to place the correct side or finished surface on the outside.

While there are both manual and automated tools available for everting fabric tubes or tubing, their use is often difficult and frustrating to the operator. Heretofore it has been difficult to evert long tubes of flexible material, particularly where the diameter of the tube was small. It has been noted that the problem is significant in the manufacturing of piping such as that found along the seams of upholstery and in other areas including the manufacture of fabric covered belts or decorative, stuffed lacing. A significant shortcoming in utilizing prior art devices is that it is necessary to insert the device into the interior of the fabric tube and make a mechanical connection to the fabric from inside the tube, and often at the closed end thereof. Since the operator is unable to see what is being done, the operation must be accomplished by a sense of touch, which is difficult and time-consuming. Furthermore, the quality of the finished product may be compromised as the result of the device poking too many holes in the material while attempting to make a satisfactory attachment, since the operator cannot observe the critical aspect of this manipulation.

The problem of everting cloth tubes is not new and a number of prior art devices are known. The most common of these is the bodkin which is defined as a large blunt needle, long hair pin, or pointed tool for making holes. Other devices have been patented such as those disclosed in U.S. Pat. Nos. 2,156,339; 2,626,090; and 3,643,840 which disclose several examples of devices which facilitate the reversal of cloth tubes. In U.S. Pat. No. 2,156,339, the fabric to be everted is pierced by a hook projecting from one end of a cylindrical member. Once engaged by the hook, the tube can be everted by sliding the tube off the end of the cylindrical member where the end of the fabric tube is hooked. In U.S. Pat. No. 2,626,090, the fabric tube is clamped between a pair of grips at the end of a cylindrical member while the fabric tube is slid off the cylindrical member as in patent '339. In U.S. Pat. No. 3,643,840, the cloth tube is arranged around the outer diameter of a cylindrical member and fabric engagement means pulls the cloth tube partially into the cylindrical tool. The cloth tube is reversed by pulling it off of the tool. In each of these prior art devices, the everting tool connecting means is arranged within the cloth tube, thereby hiding from sight the step of fabric attachment. Furthermore, utilization of the prior art tools to evert cloth tubes is made increasingly difficult as the diameter of the cloth tubes is made smaller, or the fabric selected is of a harder or less flexible material.

SUMMARY OF THE INVENTION

The tube everting device of the present invention is comprised of an elongated hollow body member, preferably of cylindrical shape, having a convergent passageway entrance at one end thereof and a fabric or cloth attachment member connected to a handle member which is adapted to be selectively introduced into or removed from the other end of said hollow body. The handle is joined to the fabric attachment member by a connecting means which is arranged within the interior of said hollow body when the handle member is introduced within said one end thereof. The fabric attachment member is adapted to freely move within and from the interior passageway of said hollow body to the exterior at either end thereof, and can take numerous forms such as that of a hook, or a bodkin of the type shown in U.S. Pat. No. 1,747,436. In the method of operation, the cloth or fabric tube is engaged by the fabric attachment member extending outwardly of the hollow body from the end having a convergent passageway entrance. The engagement of the fabric by the fabric attachment member is consummated exteriorly of the cylindrical body, in full view of the operator. While holding the body of the tool in one hand, the operator then grasps the handle member with the other, pulling the cloth tube into the tool body passageway by pulling the handle member outwardly away from the tool body. The cloth tube gathers as it enters the hollow tool body through the convergent entrance, and is in a gathered condition as it emerges from the opposite end. The fabric attachment means is removed from the cloth tube which is then spread downwardly over the open end of the hollow tool. The cloth tube is then pulled downwardly over the outside of the tool body until the entire tube is reversed, whereupon the tool body is removed from inside the everted cloth tube.

BRIEF DESCRIPTION OF THE DRAWINGS

The novel cloth tube everting device and method of the present invention, together with their numerous objects and advantages will be better understood and described by reference to the following drawings in which the same elements bear the same reference numerals throughout the several figures.

DESCRIPTION OF THE PREFERRED EMBODIMENTS

Figure 1:
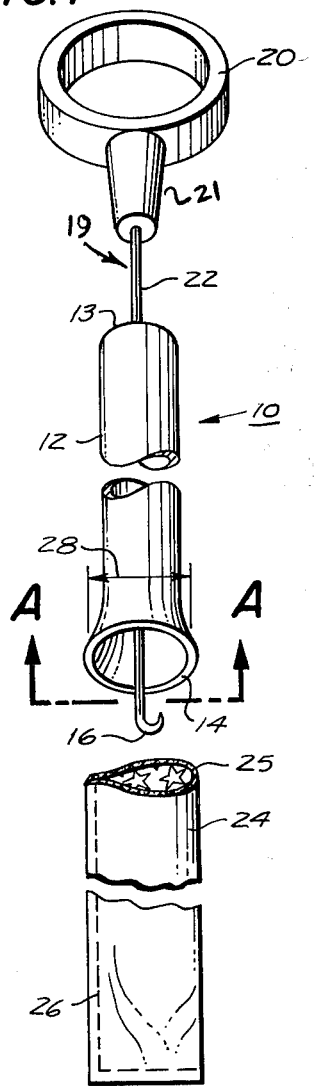
FIG. 1 shows the novel tube everting device in a side perspective view showing its relationship to a tube of fabric.
Figure 3:
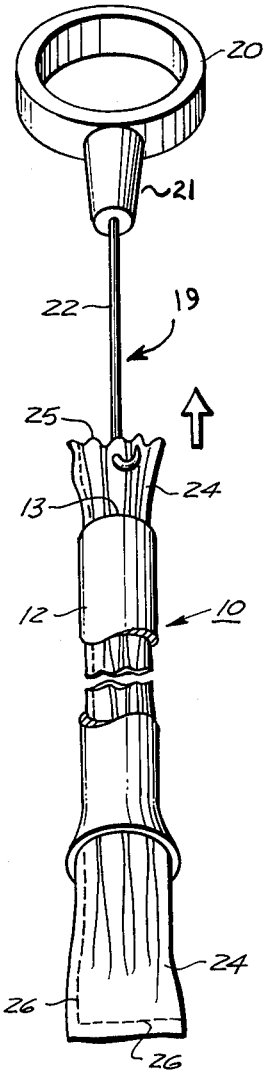
FIG. 3 is a side plan view showing the entrance and emergence of the gathered fabric tube from the hollow tool body as the handle is drawn upwardly.
Figure 4:
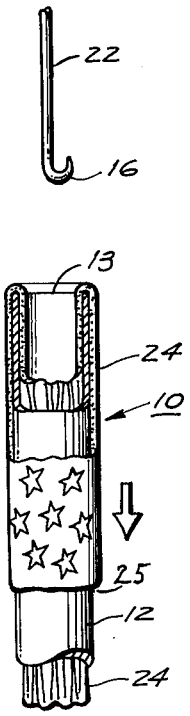
FIG. 4 is a side plan view showing the fabric tube as it emerges from the device with the tube of fabric slipped over the tool body and partially reversed.

The novel everting device 10 of the present invention and a tubular sleeve 24 of fabric material as shown in FIGS. 1, 3 and 4. The everting device, generally designated 10, basically comprises an elongated hollow tool body member 12 with an interior passageway 18 having a convergent entrance 14 at one end thereof. A fabric attachment member 16, adapted to freely move within the interior passageway 18 of said body member 12 to the exterior at either end of said body member 12, and which may be in the form of a hook or bodkin or the like, is connected to a handle member 20 by a connecting means 22. The handle member 20 is adapted to be selectively introduced into or removed from the end 13 of the hollow tool body 12 opposite the convergent entrance 14. When the handle member 20 is introduced into the body member 12, the connecting means 22 is arranged within the interior of said tool body 12, thereby extending the fabric attachment member 16 outwardly through the convergent entrance 14 for engagement with the fabric tube 24. The configuration of the handle 20, connecting means 22, and fabric attachment member 16, are sometimes hereinafter referred to as the fabric pulling assembly 19. The fabric tube 24 shown in the drawing is held in tubular configuration by means of stitching 26 extending longitudinally along one side of the tube 24 and laterally at the end, although the present invention is equally operative where the cloth or fabric tube 24 is stitched only in a longitudinal direction, and has both ends open. If desired, the tube could also be of a material that had been heated along the seam or seams and bonded to bring about a tubular configuration.

In the embodiment illustrated in FIGS. 1 and 3, the handle member 20 is shown with a fitting appendage 21 in the form of a tapered lower portion so that the handle 20 is adapted to be selectively engaged in snug-fitting relationship, or disengaged, from the end 13 of the body 12 opposite the convergent passageway entrance 14. An advantage of such snug-fitting relationship is that the handle 20 and corresponding body member 12 can be assembled in a unitary structure such as when laid aside on a work bench or when packaged for sales display or shipment. Another advantage of a unitary structure is that when manipulating an assembled small tool 10 or working with a stiff fabric, the operator may grasp the cylindrical body 12 during the operation of joining the fabric attachment member 16 to the fabric tube 24, which might provide better control than simply grasping the handle member 20. It is not critical that the handle 20 be snug-fitting, however. It may be desirable to package or utilize more than one tool body 12 with a particular handle member 20 which may or may not be snug-fitting with respect to one or more of the tool bodies, depending upon the presence or absence, and configuration and dimensions of a fitting appendage 21.

The elongated cylindrical body 12 in the preferred embodiment has a circular cross-section, however, other sectional shapes may be employed with equal facility so long as the wall thickness is adequate to prevent collapse of the wall under normal use contemplated for the everting device. The particular material from which the body member 12 is constructed may be either a metal, a plastic, or a fiber-reinforced composite or the like.

Figure 1B:
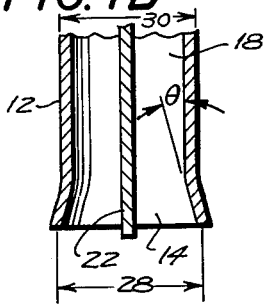
FIG. 1B is a sectional view of the device of the present invention taken along line B—B of FIG. 1A showing the convergent passageway entrance.
Figure 1A:
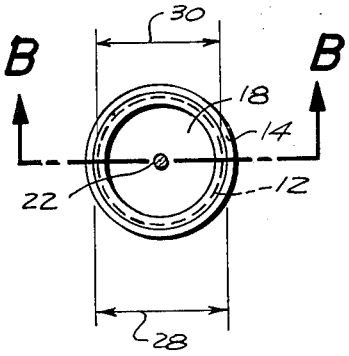
FIG. 1A is a bottom plan view of the device along section line A—A of FIG. 1, illustrating the convergent passageway entrance at one end of the device.

A particular feature of the present invention is the convergent or flared passageway entrance 14 at the end of the tool body member 12, as shown in FIGS. 1, 1A and 1B. The purpose of the convergent entrance 14 is to facilitate and maintain the bunching or gathering of the fabric as the cloth tube 24 enters and is drawn through the interior 18 of the tool body 12. The gathered condition of the fabric tube 24 eases the operation of folding it back and downwardly along the body 12 as it emerges from the end 13. It has been found more difficult to evert fabric tubes 24 without the flare 14, particularly when the harder, less flexible fabrics are utilized. In comparative tests, up to double the force has been required to pull fabric tubes through an unflared body as to pull fabric tubes through a flared end body, the additional amount of force required being a function of the flexibility and type of fabric utilized as well as the surface or applique thereof.

It has been found that with the flared embodiment illustrated in the figures, the elongated hollow body member 12 should be provided with a convergent passageway entrance 14 having a flare angle $\theta$ of from about 15° to about 45° and with the flare diameter 28 being from about 1.2 to 1.8 times the outside diameter 30 of the unflared cylindrical portion of the body member 12. Preferably, the flare angle $\theta$ should be between about 30° to about 38°.

Figure 2A:
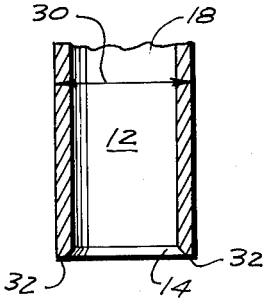
FIG. 2A is a sectional view of an alternate convergent passageway entrance.
Figure 2B:
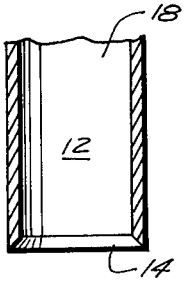
FIG. 2B is yet another variation of a cylindrical tool having a convergent passageway entrance.

FIGS. 2A and 2B show alternate convergent entrance passageways 14. The embodiment in FIG. 2A shows a land portion 32 between the outer diameter 30 of the hollow body member 12 before the wall begins to converge inwardly to form the convergent entrance 14 to the interior passageway 18, whereas FIG. 2B shows an embodiment wherein the outer wall of the body member 12 commences an inward convergence immediately to form the convergent entrance 14 to the interior passageway 18 of the hollow body member 12. In both embodiments the flare angle should be from about 15° to about 45°, preferably being from about 30° to about 38°.

In the method of operation, the fabric attachment member 16 is passed through the interior 18 of the tool body 12 by introducing the handle 20 into the end 13 of the body 12 until the fabric attachment member 16 extends outwardly of the tool body 12 at the other end. The fabric attachment member 16 is secured to the fabric tube 24 near the open end 25 in full view of the operator. The operator then holds the body member 12 in one hand, grasping the handle 20 with the other and pulls the fabric tube 24 into the interior passageway 18 of the hollow body member 12 through the entrance 14. As shown in FIG. 3, the material 24 is pulled up inside the body 12 through the interior passageway 18 to emerge at the end 13 therefrom, and the fabric attachment member 16 can be removed from the material as shown in FIG. 4. The fabric pulling assembly 19, (comprising handle 20, connecting means 22 and fabric attachment member 16) may be laid aside. As further shown in FIG. 4 the open end 25 of the fabric tube 24 is spread over the open end 13 of the tool body 12 and pulled downwardly over the outside of the body until the entire fabric tube 24 is reversed with the pattern showing on the outside surface thereof. The tool body 12 may then be removed from inside the fabric tube 24 and the tool 10 reassembled for reuse.

What has been disclosed is a novel and unusual tool which may be utilized in a novel method for eversion of a fabric tube wherein the operation of mechanical connection of the tool to the fabric is completely visible. While the process has been described in terms of a manual operation, it can obviously be automated. Furthermore, when a convergent entrance passageway is utilized, the material is readily gathered or bunched as it is brought up through the tool and the gathering maintained, thereby easing the reversal operation for smaller diameter fabric tubes and those made of less flexible fabrics.

It is contemplated that the tool of the present invention would be provided to users in a plurality of different sizes, the handle members 20 and the body members 12 being of an identical color for a particular size. Such color coding would make for easy size identification and also matching the proper handle with body when a plurality of tools are utilized at the same time. Furthermore, the body member 12 could be made of a transparent material, although this is not necessary. Another possibility is to provide the present invention in a combination where a single fabric pulling assembly 19 is utilized with more than one body member 12 of differing diameters 30, which may be stacked, one within another on a display board, or in storage, to conserve space.

I claim:

1. A device for everting a tube of fabric comprising: an elongated hollow body member; a handle member adapted to be selectively introduced into, or removed from, the immediate vicinity of a first end of said hollow body member; a fabric attachment member adapted to freely pass within the interior of said hollow body to the exterior thereof at either the first or other end of said body member; and means connecting said handle member to said fabric attachment member; said fabric attachment member being further adapted to extend outwardly from the other end of said hollow body member after passing through the interior of said hollow body member as the handle member is introduced into the immediate vicinity of said first end of said hollow body member, and to freely pass, in the opposite direction, within the interior of said hollow body member to the exterior thereof at said first end after attachment to a tube of fabric, with said tube of fabric attached thereto.

2. A device as described in claim 1 wherein said hollow body member is generally cylindrical in form.

3. A device as described in claim 1 wherein said hollow body member is circular in cross-section.

4. A device as described in claim 1 wherein said hollow body member has a convergent passageway entrance at the other end thereof.

5. A device as described in claim 4 wherein said convergent entrance is in the shape of a flare having a flare angle between about 15° to about 45°.

6. A device as described in claim 4 wherein said convergent entrance is in the shape of a flare having a flare angle between about 30° to about 38°.

7. A device as described in claim 4 wherein said convergent entrance is in the shape of a flare and the flare diameter is from 1.2 to 1.8 times the diameter of the outer diameter of the unflared portion of said hollow body member.

8. A device as described in claim 4 wherein said convergent passageway entrance comprises a uniform gradual inward taper from the outer periphery of said hollow body member to the hollow interior thereof.

9. A tool as described in claim 4 wherein the convergent passageway entrance comprises a uniform gradual inward taper from a point inwardly offset from the outer periphery of said elongated hollow body member to the hollow interior thereof.

10. A device as described in claim 1 wherein the handle member is adapted to be selectively engaged in snug-fitting relationship into, or disengaged from said first end of said hollow body member.

11. A device as described in claim 1, and in addition, a fitting appendage arranged on said handle member whereby the handle member may be selectively engaged in snug-fitting relationship into, or disengaged from said first end of said hollow body member.

12. A device as described in claim 1, and in addition, a plurality of additional elongated hollow body members.

13. The combination of claim 12 wherein each of said body members is of a different diameter.

14. The combination of claim 13 wherein each of said body members is of a sufficiently different diameter so that a portion of the body member of at least some of them may successively nest, one within another.

15. A plurality of devices as described in claim 1, said devices being of different sizes, wherein handle members adapted for introduction into corresponding body members are of the same color as at least some of the corresponding body members, but of a different color from other handle members, to provide ready size identification and ease of matching handle members with body members with which they are to be associated.

16. The method of turning or reversing tubular fabric articles exemplified by belts, neckties and the like, with the assistance of a tool comprising an elongated hollow body member, a handle member adapted to be selectively introduced into, or removed from the vicinity of a first end thereof, a fabric attachment means, and means connecting said handle member to said fabric attachment means, which method comprises passing the fabric attachment means through the interior of said hollow body member in a first direction to extend outwardly therefrom by introducing the handle member into the immediate vicinity of said first end of said body member, securing said fabric attachment means to said tubular fabric article to be turned, and drawing said tubular fabric article interiorly into said hollow body member by moving the handle member outwardly from the body member in the opposite direction until said tubular fabric article extends exteriorly from said first end of said body member; removing the fabric attachment means from securement to the tubular fabric article; and completing the turning of the tubular fabric article by pulling the tubular fabric article in said first direction along the outer surface of the body member until the tubular fabric article is completely reversed; and then removing the tubular fabric article from the outer surface of said body member.

17. The method of claim 16 wherein the hollow body member is cylindrical in configuration and has a flared portion at the end where the tubular fabric article is drawn interiorly.

* * * * *